US012352110B2

(12) United States Patent
Clark et al.

(10) Patent No.: US 12,352,110 B2
(45) Date of Patent: Jul. 8, 2025

(54) DRILL BIT CUTTER WITH STRESS REDUCING FEATURES

(71) Applicant: Halliburton Energy Services, Inc., Houston, TX (US)

(72) Inventors: Kevin Clark, Willis, TX (US); Randy T. Howell, Conroe, TX (US); Jeffrey G. Thomas, Conroe, TX (US); Nicholas Allison, Conroe, TX (US); John Varner, The Woodlands, TX (US); Kelley Plunkett, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/209,224

(22) Filed: Jun. 13, 2023

(65) Prior Publication Data

US 2023/0407708 A1 Dec. 21, 2023

Related U.S. Application Data

(60) Provisional application No. 63/353,265, filed on Jun. 17, 2022.

(51) Int. Cl.
*E21B 10/573* (2006.01)
*E21B 10/42* (2006.01)

(52) U.S. Cl.
CPC ..... *E21B 10/573* (2013.01); *E21B 10/42* (2013.01)

(58) Field of Classification Search
CPC ..... E21B 10/573; E21B 10/42
See application file for complete search history.

(56) References Cited

U.S. PATENT DOCUMENTS

| | | | |
|---|---|---|---|
| 7,389,834 | B1 | 6/2008 | Kembaiyan |
| 7,661,765 | B2 | 2/2010 | Hall et al. |
| 7,740,090 | B2 | 6/2010 | Shen et al. |
| 8,074,869 | B2 | 12/2011 | Lyons et al. |
| 8,360,176 | B2 | 1/2013 | Zhang et al. |
| 8,439,137 | B1 | 5/2013 | Galloway |
| 8,777,088 | B2 | 7/2014 | Trinh et al. |
| 8,863,864 | B1 | 10/2014 | Miess |
| 9,303,460 | B2 | 4/2016 | Schwefe et al. |

(Continued)

FOREIGN PATENT DOCUMENTS

| | | |
|---|---|---|
| CN | 109108295 | 1/2019 |
| CN | 211219252 | 8/2020 |

(Continued)

*Primary Examiner* — Kristyn A Hall
(74) *Attorney, Agent, or Firm* — Michael Jenney; C. Tumey Law Group PLLC

(57) ABSTRACT

A variety of methods, systems, and apparatus are disclosed, including, in one embodiment, a drill bit, comprising: a bit body defining a rotational axis and having a plurality of cutter pockets formed thereon, each cutter pocket shaped to receive a respective substrate of a cutter with a cutting table secured thereon, wherein the substrate of at least one cutter has an outer profile defining an area of increased braze gap; and a braze interface comprising a braze alloy disposed in each cutter pocket between the inner profile of the cutter pocket and the outer profile of the respective substrate, such that a thickness of the braze alloy is greater at the area of increased braze gap.

15 Claims, 8 Drawing Sheets

(56) References Cited

U.S. PATENT DOCUMENTS

| | | | | |
|---|---|---|---|---|
| 9,488,012 | B2 | 11/2016 | Thigpen | |
| 9,580,969 | B2 | 2/2017 | Wardley et al. | |
| 9,987,726 | B2 | 6/2018 | Olsen | |
| 10,240,398 | B2 | 3/2019 | Anderle et al. | |
| 10,352,103 | B2 | 7/2019 | Maw | |
| 2004/0245022 | A1 | 12/2004 | Izaguirre et al. | |
| 2010/0276210 | A1 | 11/2010 | Prajapati et al. | |
| 2010/0288563 | A1 | 11/2010 | Smith | |
| 2013/0175097 | A1* | 7/2013 | Wardley | E21B 10/573 29/458 |
| 2016/0017668 | A1 | 1/2016 | Meier et al. | |
| 2016/0201399 | A1 | 7/2016 | Bird et al. | |
| 2016/0256947 | A1 | 9/2016 | Arfele | |
| 2017/0191315 | A1 | 7/2017 | Saini et al. | |
| 2018/0128055 | A1 | 5/2018 | Saini et al. | |
| 2018/0169796 | A1 | 6/2018 | Clark et al. | |
| 2023/0151698 | A1 | 5/2023 | Russell et al. | |

FOREIGN PATENT DOCUMENTS

| | | |
|---|---|---|
| GB | 2479844 | 10/2011 |
| WO | 2010088504 | 8/2010 |
| WO | 2015072980 | 5/2015 |

* cited by examiner

DRILL BIT CUTTER WITH STRESS REDUCING FEATURES

CROSS-REFERENCE TO RELATED APPLICATIONS

The present application is a non-provisional of U.S. Patent Provisional Application No. 63/353,265, filed Jun. 17, 2022, the entire disclosure of which is incorporated herein by reference.

BACKGROUND

A well is drilled by rotating a drill bit at the end of a drill string. The entire drill string may be rotated using surface equipment, and/or the bit may be rotated relative to the drill string with a downhole motor. The well may be drilled to any desired depth by progressively adding segments of drill pipe from the surface of the wellsite. While drilling, drilling fluid is pumped down the drill string, through nozzles on the drill bit, and up an annulus between the drill string and wellbore to lubricate the bit and remove cuttings and other debris to the surface. The process of drilling thus exposes drill bits and other drilling equipment to extreme conditions such as high stresses, temperatures, and wear.

A fixed cutter drill bit is a type of drill bit having a plurality of cutters secured at fixed positions to a bit body. Each cutter may include a cutting table made of an ultra-hard material, such as polycrystalline diamond or boron nitride, secured to a carbide substrate. A fixed cutter bit body is formed from a high strength material, with a plurality of cutter pockets formed on the bit body. Each cutter pocket receives one cutter, which is secured to the pocket by brazing. Over time, the drill bit may gradually wear and/or fail from high forces exerted on the drill bit as it bears against the formation while drilling.

It is common to have to replace worn or damaged cutters, or even an entire drill bit, in the course of drilling a well. Drilling is very time- and cost-intensive, and the extra rig time incurred to trip out of the wellbore and repair or replace a bit can be expensive. A great deal of effort and expense has therefore been devoted to improving the durability of drill bits. Much of this focus over the years has been on improving the diamond materials used in cutters to make them harder, tougher, and more wear resistant.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
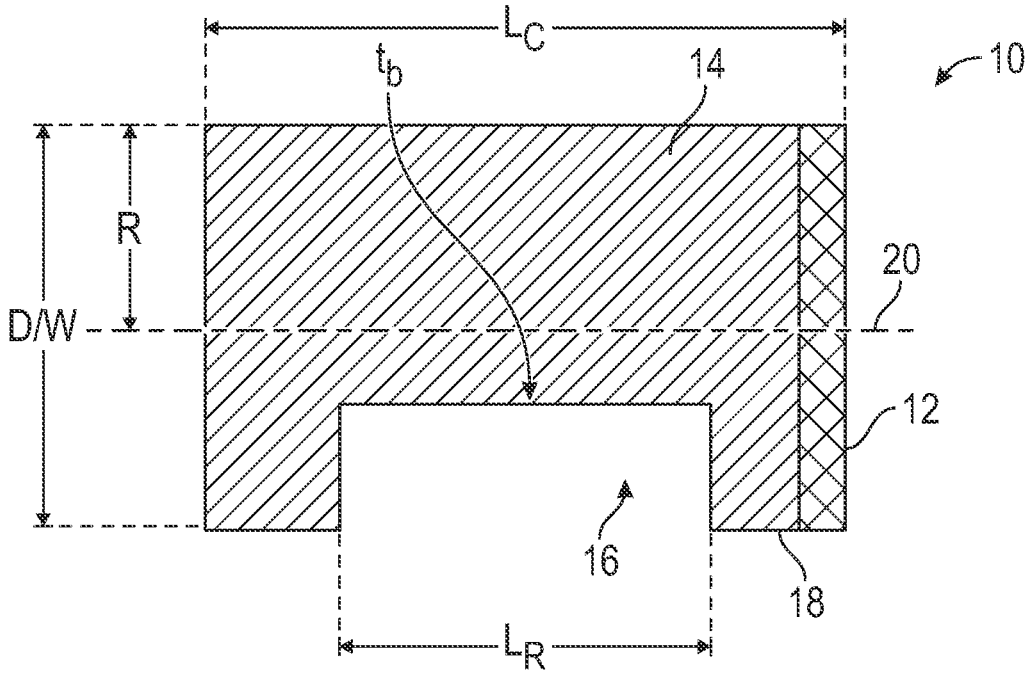
FIG. 1 is a side view of a cutter with a recess in accordance with some embodiments of the present disclosure.

The present disclosure is generally related to drill bits and, more particularly, to improving longevity of fixed cutter drill bits by improving the brazing interface of the cutters with the cutter pockets of a bit body. For example, example embodiments relate to creating a more compliant braze joint that reduces the stress in the system as compared with a thin and uniform braze layer. The disclosure encompasses, without limitation, a braze joint, a drill bit incorporating such a braze joint, a method of designing such a drill bit, and a method of drilling with such a drill bit.

In general, a properly made brazed joint will be as strong or stronger than the metals being joined. In a typical cutter, the substrate material of the cutter being joined to the cutter pocket is a metal, such as tungsten carbide, which may have a tensile strength on the order of 350 MPA and a compressive strength on the order of 4780 MPA. Conventional understandings and approaches with brazing that have called for using a very thin and uniform braze layer along the entire interface between the cutter substrate and the cutter pocket. However, an aspect of this disclosure is to manage the strength of the braze interface by manipulating the braze gap to have a lower strength (thicker) braze gap in areas of higher tension and higher strength (thinner) braze gap in areas of higher compression loads relative to the forces induced by drilling.

Example of embodiments of the present disclosure focus on the shape of the portion of the cutter within the cutter pocket, including selecting (e.g., designing, forming, and/or modifying) the shape of a cutter where it is interfaces with the cutter pocket on a bit body to selectively increase the resultant braze thickness between the cutter and cutter pocket at strategic locations. However, in some examples the cutter pocket may also be selected to selectively increase the resultant braze thickness. A gap between the cutter and the cutter pocket may define a gap to be occupied by a braze material, i.e., a braze gap. The braze that fills the gap may have a corresponding braze thickness. Thus, the braze is thicker within the area of increased braze gap than outside the area of increased braze gap. An area of increased braze gap may include, for example, a recess or a taper defined by an outer profile of the cutter (and/or defined by an inner profile of the respective cutter pocket in some examples). Thus, an area of increased braze gap may be created by designing, forming, and/or modifying the cutter and/or cutter pocket. This variable braze thickness may spread out or otherwise redistribute the loading at the braze interface, giving the cutter the ability to take a higher load before it fractures. This challenges or defies conventional understandings and approaches with brazing that have called for using a very thin and uniform braze layer along the entire interface between the cutter substrate and the cutter pocket. Aspects of the disclosure help to mitigate the stress in the carbide and braze joint that help to improve cutter retention and cutter life. This may also enable drilling more challenging applications that ordinarily would have a high cutter fracture rate.

In examples, the redistribution of stress at the braze interface is accomplished by incorporating one or more recesses and/or tapers along the cutter in specific areas that allow for a thicker braze joint in those areas. Recent testing under certain configurations and conditions reveals that the thicker portion of the braze joint is more ductile and allows the cutter to move slightly more than it otherwise would with a thin and uniform braze layer. This very small movement allows the cutter load to be spread out across the joint versus being concentrated in one area. Spreading the load out, in turn, reduces the stress in the system.

Analytical techniques such as finite element analysis (FEA) simulations and calculations (as generally understood in the art apart from the specific teachings of this disclosure), applied to evaluate stress on the cutters and specifically at the braze joints, have found that the stress in the braze layer and the cutter is reduced by increasing the braze layer thickness. Cutters and cutter materials may last longer, even without any further improvements to the diamond used in the cutting table. Testing has also confirmed that the carbide fracture load increased when a central recess was introduced to the pocket. In at least some configurations, such a recess may have a depth in the range of between 0.010 inches and 0.1 inches (0.254 mm to 2.54 mm) and an angle in a range of 20 degrees to −90 degrees. In one example, FEA results suggest a recess comprising an annular groove (discussed below, e.g., see general shape of recess 20, FIG. 1) with a depth of 0.03 inches (0.762 mm thick) and a length of 0.2 inches (5.08 mm length) with an expanding 60-degree angle yield minimum stress in the carbide and the braze layer.

The cutter (as discussed further below and illustrated regarding specific example configurations) may define a cutter axis useful as reference geometry, which in the example of a cutter with a cylindrical or otherwise round cross section may be the centerline. In some example configurations, the recess may be provided on the substrate along an annular groove between the substrate and the respective cutter pocket. In other example configurations, the recess may extend beyond the substrate and at least partially into the cutting table. The gap width (e.g., as measured circumferentially about a cutter axis), depth (e.g., as measured radially toward the cutter axis), and/or length (e.g., as measured axially in a direction of the cutter axis) can be optimized for the desired stress reducing effects. In some examples, the gap could span less than 180 degrees, and may be located in a region where the braze is in tension during drilling loading. In other examples, the gap could exceed 180 degrees, up to a continuous annular groove effectively spanning 360 degrees. In some examples, an optimal angle may be on the order of an angular width of 60 degrees, a depth of 0.03 inches (0.762 mm), and a length of 0.2 inches (5.08 mm) long among the candidate angles (60 degrees to 120 degrees), depths (0.005 inches to 0.1 inches (0.127 mm to 2.54 mm)) and lengths (0.2 inches to 0.5 inches (5.08 mm to 12.7 mm).

In other example configurations, a recess formed on the substrate may be on the back of the cutter, i.e., on the end of the cutter opposite the cutting table. This recess location may help reduce the braze gap in the back of the pocket in the area of highest compressive loading. A smaller gap close to zero will allow better load transfer which again will reduce cutter stress. Such a gap could be built as designed and with it being wider in the areas with higher tensile/lower compressive loads and approaching zero in the higher compression/lower tensile loads. In use there would be some compliance, but it would be on the order of 0.0001 inches (0.00254 mm) and could be in a range of between 0.00005 inches to 0.005 inches (0.00127 mm to 0.127 mm).

In some embodiments, a drill bit may be designed, for example, to have improved brazing at the interface of the cutters with the cutter pockets of a bit body. For example, an expected loading may be obtained, wherein the loading is on a plurality of fixed cutters received in pocket of a bit body. From at least this loading, one or more regions may be identified to increase a thickness of a braze interface between each fixed cutter and a cutter pocket. In addition, the shape of a substrate of the fixed cutter may be selected to increase the resultant braze thickness at the one or more regions to spread out or otherwise redistribute the loading at the braze interface. Selecting the shape may include designing, forming, or otherwise modifying the shape of the substrate. In some embodiments, identifying one or more regions to increase a thickness of a braze interface may comprise identifying a region where the braze interface is expected to be in tension, and wherein selecting the shape of a cutter substrate, to increase the resultant braze thickness at the one or more regions comprises positioning a recess at the region where the braze interface is expected to be in tension.

FIG. 1 illustrates a representative fixed cutter ("cutter") 10 having a cutting table 12 secured to a substrate 14, wherein a thickness of a braze layer is selectively increased. For example, a recess 16 comprising an annular groove is formed in the outer profile 18 of the substrate 14 to selectively increase the thickness of the braze layer. The substrate 14 may be formed of a very hard material, such as a carbide (e.g., tungsten carbide or WC). The cutting table 12 may be formed of an even harder material, such as polycrystalline diamond (PCD), which is positioned by virtue of its orientation on the bit body to directly engage an earthen formation during drilling, while supported on the substrate 14 as mounted to a drill bit body (not shown). The cutting table 12 may be simultaneously formed in a press by bonding diamond particles to themselves and to the substrate 14 during a high-temperature, high-pressure (HTHP) sintering process. The shape of the cutter 10, including the substrate 14 and/or cutting table 12, may be achieved, at least in part, by the shape of a vessel (e.g., pressing can) in which it is formed during sintering, and may be further formed or shaped after sintering according to any suitable technique, such electro discharge machining (EDM).

The cutter defines a cutter axis 20, which in the optional case of a cylindrical cutter would have a diameter "D" and a radius "R" about the cutter axis 20. The cutter has a length ($L_c$) in an axial direction aligned with the cutter axis 20 and a lateral width (W) equal to the diameter (D) in the case of a round cutter. The recess 16 is formed on the outer profile 18 of the substrate 14. The recess 16 is radially protruding into the substrate 14 and extends axially a length ($L_r$) for example, of between 5% to 90% of the overall length ($L_c$) of the cutter 10. The recess in this example terminates below the cutting table 12 but could alternatively extend at least partially or fully through the cutting table 12 in an alternate configuration.

Figure 2:
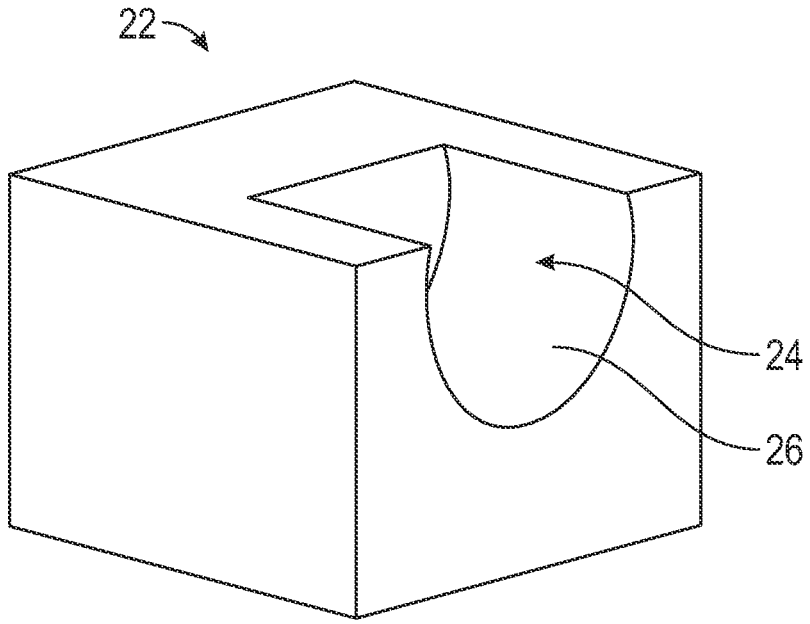
FIG. 2 is a perspective view of a cutter pocket in accordance with some embodiments of the present disclosure.

FIG. 2 illustrates a representative body 22, which may be a portion of a bit body, for example. As illustrated, a cutter pocket 24 may be formed in the body 22. The cutter pocket 24 may have an inner profile 26. With additional reference to FIG. 3, the cutter 10 may be received in the cutter pocket 24 formed in the body 22. A gap or recess 28 comprising an annular groove exists between the outer profile 18 of the cutter 10 (or at least of the substrate 14, as at least a portion of the cutter 10 extends outside the cutter pocket 24) and the inner profile 26 of the cutter pocket 24 into which the cutter 10 is to be received. The cutter 10 may be secured within the cutter pocket 24 via a brazing process. That is, a braze material (i.e., a "braze) 30 may be melted and directed to flow into the gap or recess 28 between the outer profile 18 of the substrate 14 and the inner profile 26 of the cutter pocket 24. The braze 30 may fill the entire space between the outer profile 18 of the substrate and the inner profile 26 of the cutter pocket 24. Once cooled, the braze joins the cutter 10 to the cutter pocket 24. The braze 30 may include any suitable braze alloy. For example, the braze may include copper, nickel, silver, or gold based alloys that include other constituents such as tin, zinc, titanium, zirconium, nickel, manganese, tellurium, selenium, antimony, bismuth, gallium, cadmium, iron, silicon, phosphorous, sulfur, platinum, palladium, lead, magnesium, germanium, carbon, oxygen, as well as other elements. Moreover, the outer profile 18 and inner profile 26 are generally shaped to conform to one another, except that the gap is thicker at the recess 16. The term braze interface in this context may refer to the entirety of the braze 30 at this interface. A uniform layer (e.g., less than 0.010") of the braze 30 may be formed in the annular gap 28 outside the recess 16. The layer of the braze 30 will be thicker at the recess 16 than outside the recess 16. In some cases, a depth of the recess 16 and a corresponding thickness "$t_{b1}$" of the braze 30 in the recess 16 may be between 0.010 inches and 0.40 inches (0.254 mm to 1.016 mm), and the thickness of the braze 30 outside the recess 16 ($t_{b2}$) will be thinner than the layer of the braze 30 in the recess 16, such as less than 0.010 inches (0.254 mm). The braze 30 may have a uniform thickness (($t_{b2}$) throughout the braze interface between the outer profile 18 of the cutter 10 and the inner profile 26 of the cutter pocket 24 except for in the recess(s) 16.

Figure 3:
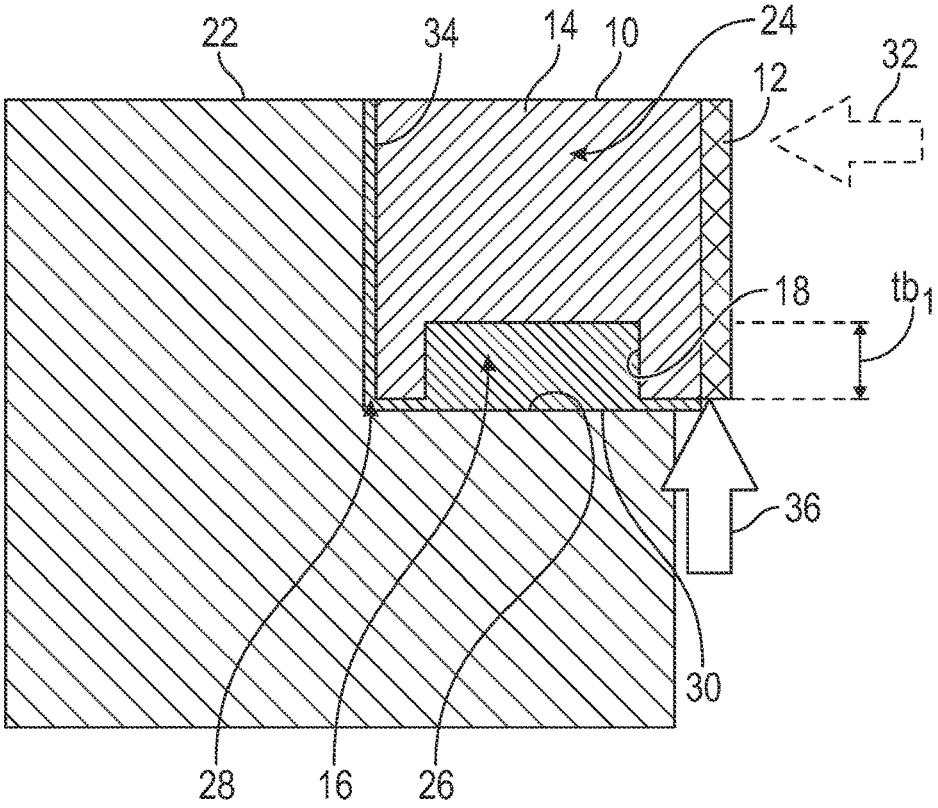
FIG. 3 is a cross-sectional side of the cutter of the general configuration of FIG. 1 mounted in the cutter pocket of FIG. 2 in accordance with some embodiments of the present disclosure.

With continued reference to FIG. 3, a resultant cutter loading would be applied to the cutting table in the direction shown by arrow 32. The cutter loading during drilling may comprise a reaction force at the formation engaged by the cutting table. The cutter loading is represented as a vector whose magnitude and direction may differ from the simplification in the drawing. The cutter loading would tend to create a region of tension in the braze 30 in the region of the recess 16, and a region of compression at the back (i.e., bottom end 34) of the cutter 10. Likewise, a cutaway test pocket can allow a test load to be applied that also creates tension at the recess 16 and compression at the bottom end 34 of the cutter 10. This test load is represented by arrow 36. The same experiment may be performed electronically such as part of a design simulation. It has been determined that under certain parameters have a great thickness ($t_{b1}$) of the braze 30 at the recess 16 allows that portion of braze 16 to deform a little further than a thinner layer would, causing a beneficial redistribution of forces elsewhere in the braze 30.

Figure 4:
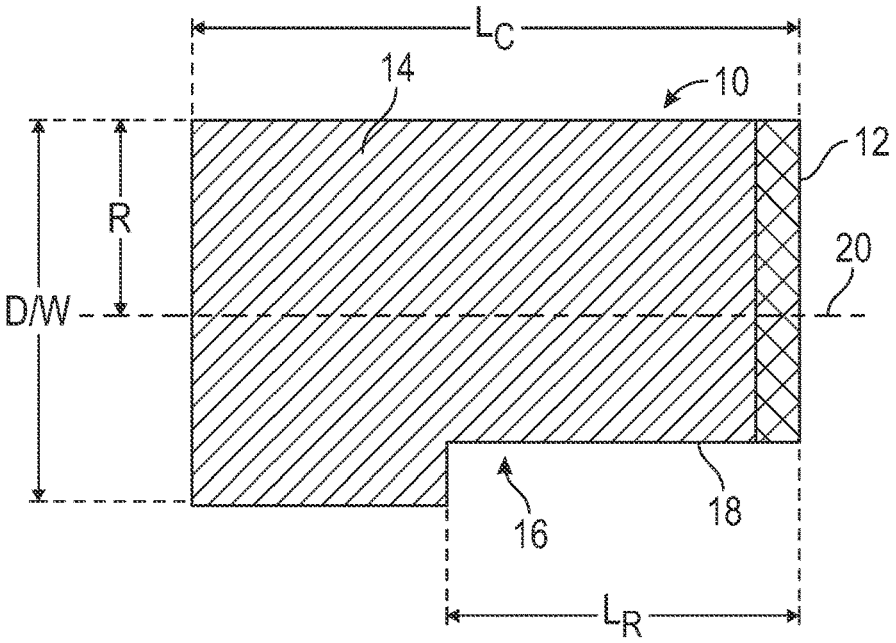
FIG. 4 is a side view of another cutter with a recess in accordance with some embodiments of the present disclosure.

FIG. 4 is a side view of a cutter 10 having a cutting table 12 secured to a substrate 14 in accordance with additional embodiments of the present disclosure. The cutter 10 may have similar attributes as the cutter 10 in FIG. 1. For example, a recess 16 comprising an annular groove is formed in the outer profile 18 of the substrate 14 to selectively increase the thickness of the braze layer. The cutter defines a cutter axis 20, which in the optional case of a cylindrical cutter would have a diameter "D" and a radius "R" about the cutter axis 20. The cutter has a length (L) in an axial direction aligned with the cutter axis 15 and a lateral width (W) equal to the diameter (D) in the case of a round cutter. The recess 16 is formed on the outer profile 18 of the substrate 14. The recess 16 is radially protruding into the substrate 14 and extends axially a length ($L_r$) for example, of between 5% to 90% of the overall length (OAL) dimensions ($L_c$) of the cutter 10. However, in contrast to the embodiment of FIG. 1, the recess 16 show on FIG. 4 does not terminate at the cutting table 12 and instead extends beyond the substrate 14. As illustrated, the recess 16 extends at least partially into the cutting table 12. In the illustrated embodiment, the recess 126 extends all the way through the full thickness of the cutting table 12.

Figure 5:
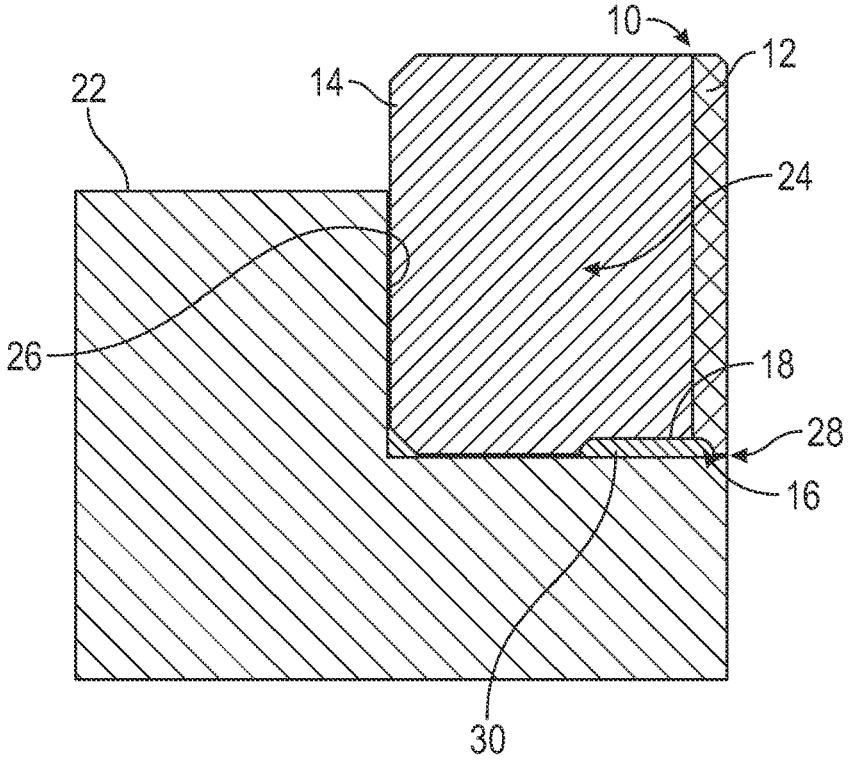
FIG. 5 is a cross-sectional side view of another cutter with a recess mounted in the cutter pocket of FIG. 2 in accordance with some embodiments of the present disclosure.

FIG. 5 illustrates a cutter 10 having a cutter table 12 secured to a substrate 14 in accordance with additional embodiments of the present disclosure. The cutter 10 may have similar attributes as the cutter 10 in FIG. 4. For example, a recess 16 comprising an annular groove is formed in the outer profile 18 of the substrate 14 to selectively increase the thickness of the braze layer. However, in contrast to the embodiment of FIG. 4, the recess 16 show on FIG. 5 extends only partially through the cutting table 12. Further illustrated on FIG. 5 is a representative body 22, which may be a portion of a bit body, for example. As illustrated, a cutter pocket 24 may be formed in the body 22. The cutter pocket 24 may have an inner profile 26. In the illustrated embodiment, the cutter 10 may be received in the cutter pocket 24 formed in the body 22. A gap or recess 28 comprising an annular groove exists between the outer profile 18 of the cutter 10, and the inner profile 26 of the cutter pocket 24 into which the cutter 10 is to be received. A braze material (i.e., a "braze) is a material, e.g., a braze alloy, used to secure the cutter 10 into the cutter pocket 24. The braze 30 may fill the entire space between the outer profile 18 of the substrate and the inner profile 26 of the cutter pocket 24. The outer profile 18 and inner profile 26 are generally shaped to conform to one another, except that the gap is thicker at the recess 16. The braze 30 may have a uniform thickness throughout the braze interface between the outer profile 18 of the cutter 10 and the inner profile 26 of the cutter pocket 24 except for in the recess(s) 16.

Figure 6:
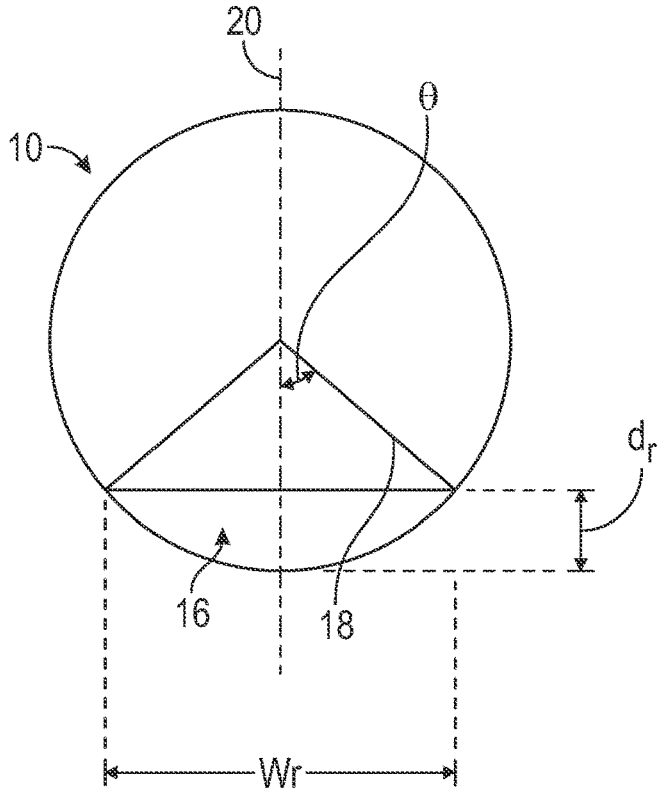
FIG. 6 is a schematic diagram of a top view of a cutter illustrating a recess in accordance with some embodiments of the present disclosure.

FIG. 6 is a schematic diagram of a top view of a cutter 10 in accordance with one or more embodiments. The schematic diagram may represent the cutter 10 of FIG. 1 or FIG. 4, for example, each of which have a recess 16 that extends only partially around the perimeter (e.g., circumference) of the cutter 10. As illustrated, the recess 16 may have an annular width of 2 times θ, wherein θ is the angle of the recess from the cutter axis 20 to the outer profile 18 of the cutter 10. In some embodiments, the angle θ may range from 5 degrees to 80 degrees. The recess 16 may also have a depth ($d_r$) and width ($w_r$). The depth ($d_r$) range may range, for example, from 0.005 inches to 0.030 inches (0.127 mm to 0.762 mm). The depth ($d_r$) of the recess 16 corresponds to the maximum thickness of the braze that would occupy the recess, for example, when mounted in a cutter pocket (e.g., cutter pocket 25 on FIG. 2, 3, or 5). The width ($w_r$) of the recess 16 may range, for example, from 0.01 inches to 0.5 inches (0.254 mm to 12.7 mm).

Figure 7:
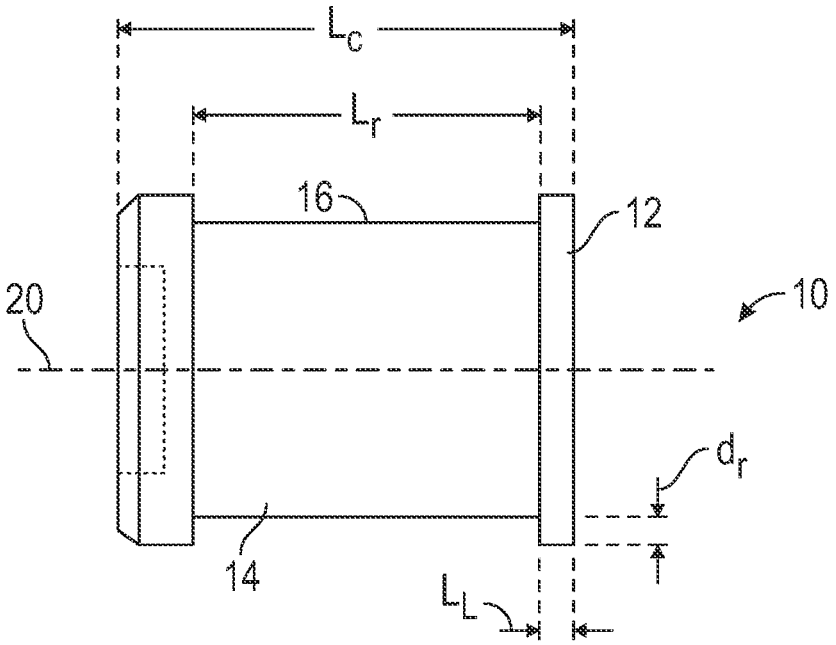
FIG. 7 is a side view of another cutter with a recess in accordance with some embodiments of the present disclosure.

FIG. 7 is a side view of a cutter 10 in accordance with additional embodiments. In the illustrated embodiment, the cutter 10 has a cutting table 12 secured to a substrate 14, wherein a thickness of a braze layer is selectively increased. For example, the cutter 10 has a recess 16 comprising an annular gap extending a full 360 degrees around the cutter axis 20 to selectively increase the thickness of the braze layer. The depth ($d_r$) range may range, for example, from 0.005 inches to 0.03 inches (0.127 mm to 0.762 mm). The depth ($d_r$) of the recess 16 corresponds to the maximum thickness of the braze that would occupy the recess, for example, when mounted in a cutter pocket (e.g., cutter pocket 25 on FIG. 2, 3, or 5). The length ($L_r$) of the recess 16 may range, for example, from 0.01 inches to 0.5 inches (0.254 mm to 12.7 mm) or from 5% to 90% of the overall cutter length ($L_c$). A lip 38 may be positioned at the front of the cutter 10 and define one end of the recess 16. In some embodiments, the lip 38 may extend past the cutting table 12 into the substrate 14. In other embodiments, the recess 16 may extend into the cutting table 12 such that the lip 38 only includes a portion of the cutting table 12. The lip 38 may have length ($L_l$) that is 1% to 20% of the overall cutter length ($L_c$), extending from 0.001 inches to 0.3 inches (0.0254 mm to 0.762 mm)

Figure 8:
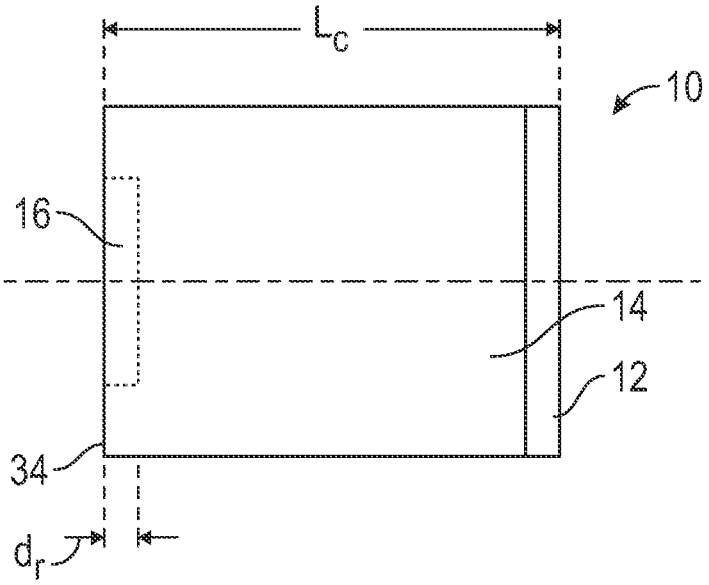
FIG. 8 is a side view of another cutter with a recess mounted on the back of the cutter in accordance with some embodiments of the present disclosure.

FIG. 8 is a side view of a cutter 10 in accordance with additional embodiments. In the illustrated embodiment, the cutter 10 has a cutting table 12 secured to a substrate 14, wherein a thickness of a braze layer is selectively increased. For example, the cutter 10 has a recess 16 on the back of the cutter 10, i.e., on the bottom end 34 opposite the cutting table 12. In some embodiments, the recess 16 may have a depth of between 0.005 inches to 0.04 inches (0.127 mm to 1.016 mm).

Figure 9:
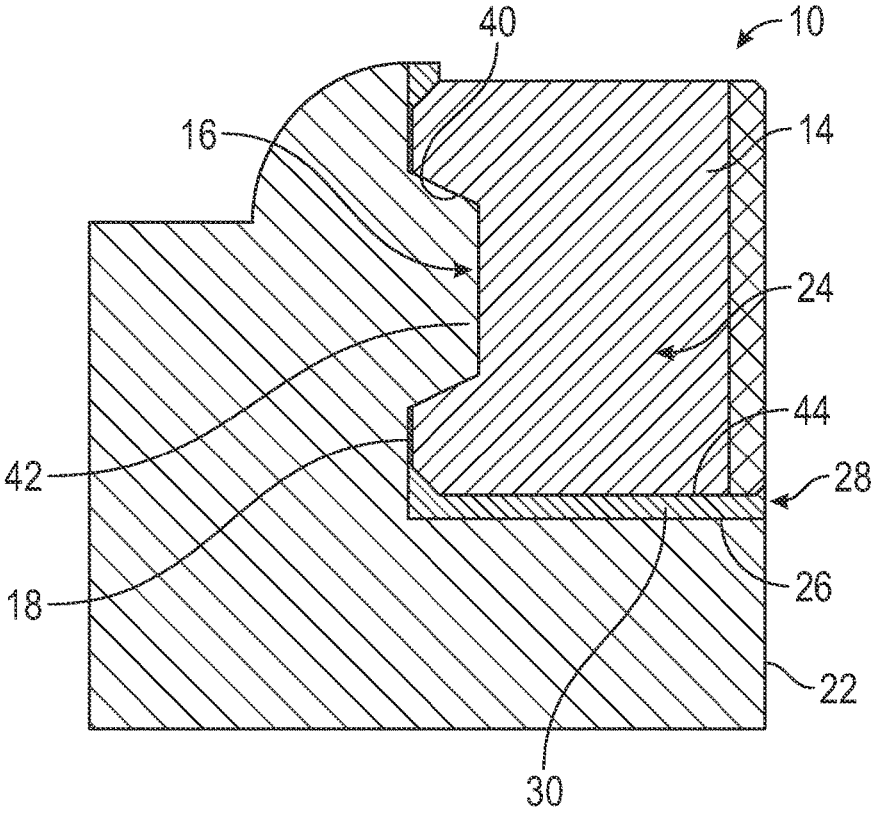
FIG. 9 is a cross-sectional side view of a cutter with a recess mounted in the back similar to FIG. 8, wherein the cutter is mounted in a cutter pocket in accordance with some embodiments of the present disclosure.

FIG. 9 illustrates a cutter 10 disposed in a cutter pocket 24 in accordance with some embodiments. In the illustrated embodiment, the cutter 10 may have similar attributes as the cutter in FIG. 8. For example, a recess 16 comprising an annular groove is formed in the outer profile 18 of the substrate 14 to selectively increase the thickness of the braze layer. However, in contrast to the embodiment of FIG. 8, the recess 16 show on FIG. 8 has angled sidewalls 40. As illustrated, a cutter pocket 24 may be formed in the body 22, which may be a portion of a bit body. The cutter pocket 24 may have an inner profile 26. In the illustrated embodiment, the cutter 10 may be received in the cutter pocket 24 formed in the body 22. As illustrated, the inner profile 26 of the cutter pocket 24 may have a pocket protrusion 42 received in the recess 16. A gap or recess 28 comprising an annular groove exists between the outer profile 18 of the cutter 10, and the inner profile 26 of the cutter pocket 24 into which the cutter 10 is to be received. A braze material (i.e., a "braze) is a material, e.g., a braze alloy, used to secure the cutter 10 into the cutter pocket 24. The braze 30 may fill the entire space between the outer profile 18 of the substrate and the inner profile 26 of the cutter pocket 24. The outer profile 18 and inner profile 26 are generally shaped to conform to one another. In the illustrated embodiment, the gap 28 is not thicker at the recess 16. However, the recess 16 cooperates with the pocket protrusion 42 to hold the cutter 10 in the cutter pocket 24 such that the portion of the gap 28 between the side 44 of the cutter 10 and the inner profile 26 of the cutter pocket 24 is increased, thus increasing the thickness of the braze 30 at that location.

Figure 10:
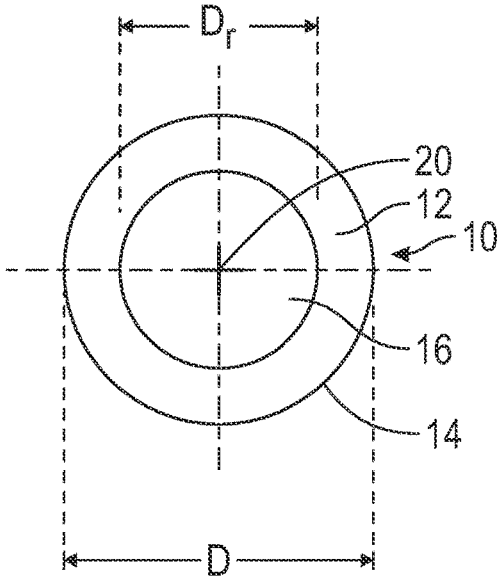
FIG. 10 is a bottom view of the cutter of FIG. 8 showing the recess on the back of the cutter in accordance with some embodiments of the present disclosure.

FIG. 10 is a bottom view of the cutter 10 of FIG. 8 showing the recess 16 on the back of the cutter 10, i.e., the bottom end 34 of the substrate 14. By way of example, the cutter 10 is generally cylindrical in shape, but other shapes are possible. In this example, the recess 16 is centrally located, i.e., coaxial with the substrate 14 about the cutter axis 20 but could alternatively be offset in other configurations. The recess 310 may have a lateral width (e.g., an outer diameter ($D_r$) of 5% to 90% of a lateral width (e.g., outer diameter (D)) of the cutter 10. In some embodiments, the recess 16 may have a lateral width or outer diameter ($D_r$) of 50% to 90% of the outer diameter (D) of the cutter 10.

Figure 11:
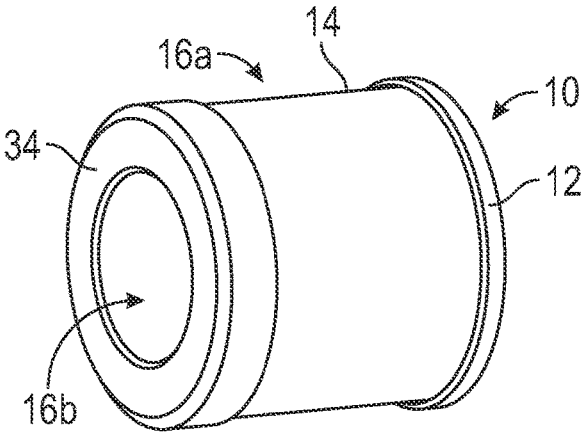
FIG. 11 is a perspective view of another cutter with both a recess comprising a groove similar to FIG. 7 and a recess in the back similar to FIG. 8 in accordance with some embodiments of the present disclosure.

FIG. 11 illustrates cutter 10 in accordance with additional embodiments. In the illustrated embodiment, the cutter 10 has a cutting table 12 secured to a substrate 14, wherein a thickness of a braze layer is selectively increased. In this example, the cutter 10 includes multiple features for selectively increasing the thickness of the braze layer. For example, the cutter 10 includes a recess **16*a* comprising an annular groove similar to the example of FIG. 7. By way of further example, the cutter 10 also includes a recess 16*b* the back of the cutter 10, i.e., on the bottom end 34 opposite the cutting table 12**.

Figure 12:
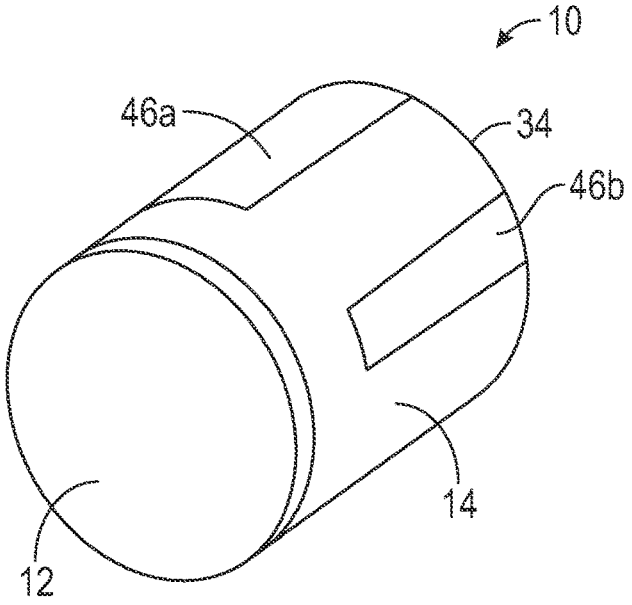
FIG. 12 is a perspective view of another cutter wherein the recess comprises a plurality of recesses portions that are circumferentially spaced in accordance with some embodiments of the present disclosure.

FIG. 12 illustrates cutter 10 in accordance with additional embodiments. In the illustrated embodiment, the cutter 10 has a cutting table 12 secured to a substrate 14, wherein a thickness of a braze layer is selectively increased. For example, the cutter 10 has a recess comprising a plurality of recessed portions **46*a*-46*d* (only 46*a* and 46*b* are visible) formed in the substrate 14 to selectively increase the thickness of the braze layer. As illustrated, the recessed portions 46*a*-46*d* may be circumferentially spaced around the substrate 14 The recess portions 46*a*-46*b* may be generally planar, i.e. "flats" in this example, but may have other shapes as desired for a particular application. The recessed portions 46*a*-46*d* in this example terminate below the cutting table 12 but could alternatively extend at least partially or fully through the cutting table 12 in an alternate configuration. Moreover, the recessed portions 46*a*-46*d* in this example extend axially all the way to the back of the cutter 10 at the bottom end 34 but could alternatively terminate prior to the bottom end 34. The recessed portions 46*a*-46*d* may have a length that extends, for example, between 5% to 90% of the overall length (OAL) of the cutter 10**.

Figure 13:
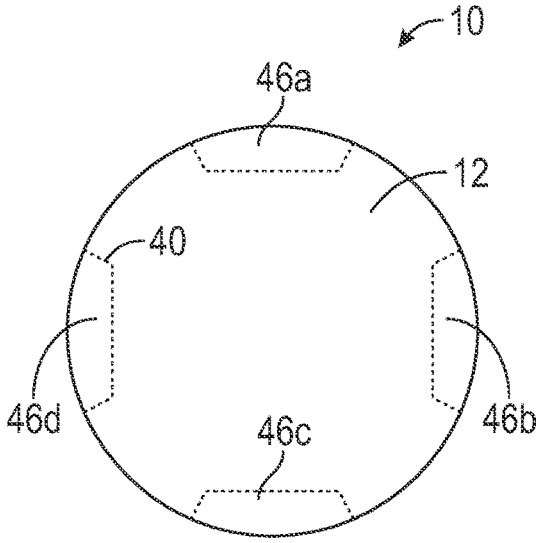
FIG. 13 is a top view of the cutter of FIG. 11 in accordance with some embodiments of the present disclosure.

FIG. 13 is a top view of the cutter 10 of FIG. 12 in accordance with some embodiments. As illustrated, the cutter 10 has a plurality of recessed portions 46*a*-46*d* that are circumferentially spaced around the cutter 10. In this example, the recessed portions 46*a*-46*d* are regularly spaced, but the spaced could be irregular in other configurations. In addition, while the present example shows 4 of the recessed portions 46*a*-46*d*, other configurations may have more or less than 4 of the recessed portions 46*a*-46 as desired for a particular application. In addition, while the recessed portions 46*a*-46*d* have angled sidewalls 40, other configurations may have sidewalls that are configured differently.

Figure 14:
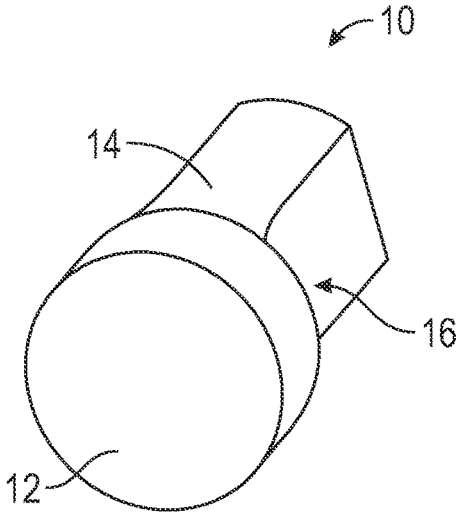
FIG. 14 is a perspective view of another cutter with a recess in accordance with some embodiments of the present disclosure.
Figure 15:
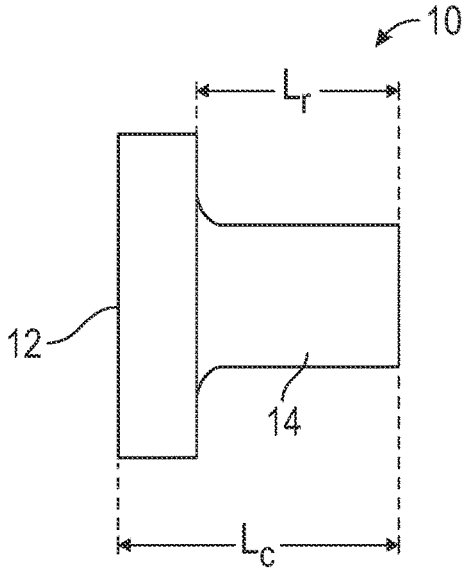
FIG. 15 is a side view of the cutter of FIG. 13 in accordance with some embodiments of the present disclosure.

FIGS. 14 and 15 illustrate cutter 10 in accordance with additional embodiments. In the illustrated embodiment, the cutter 10 has a cutting table 12 secured to a substrate 14, wherein a thickness of a braze layer is selectively increased. For example, the substrate 14 of the cutter 10 is shaped to provide a recess 16 extending along most of its axial length to thereby selectively increase the thickness of the braze layer. As illustrated, the recess 16 also may extend a full 360 degrees around the cutter axis 20. While FIG. 14 illustrates the recess 16 having a length ($L_r$) that extends most of the length of the cutter 10 ($L_c$), the recess may be formed in the substrate 14 to extend between 5% to 90% of the overall length of the cutter 10, for example, from 20% to 80% of the overall length of the cutter 10.

Figure 16:
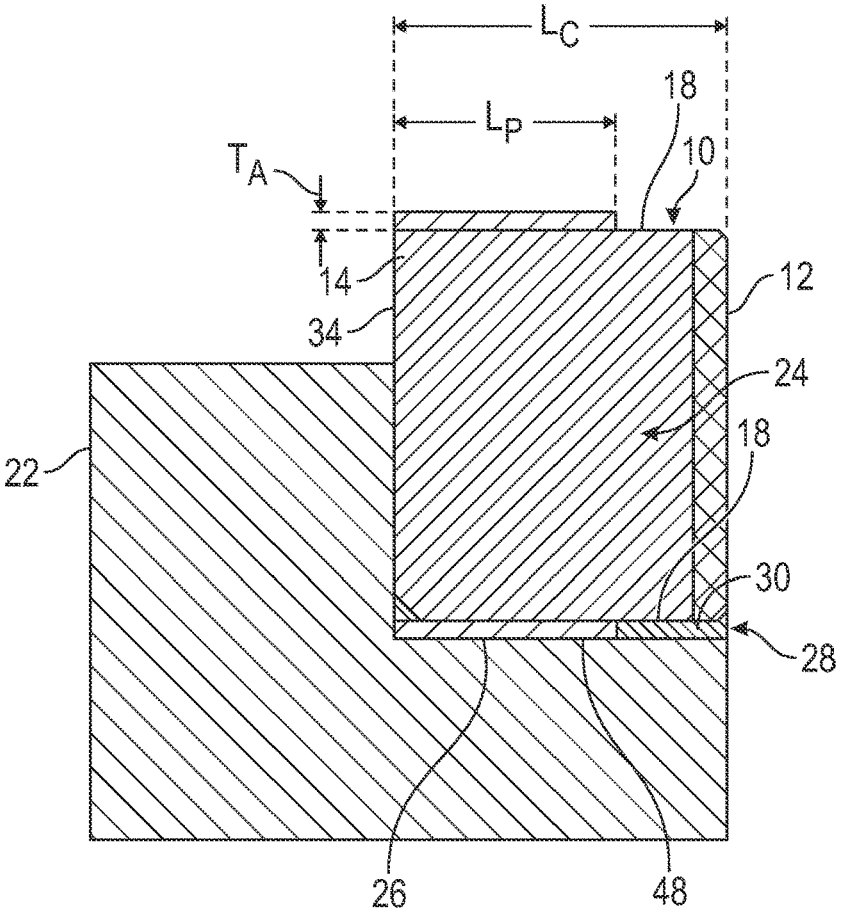
FIG. 16 is a cross-sectional side view of a cutter with a protrusion, wherein the cutter is mounted in the cutter pocket of FIG. 2 in accordance with some embodiments of the present disclosure.

FIG. 16 illustrates a cutter 10 having a cutter table 12 secured to a substrate 14 in accordance with additional embodiments of the present disclosure. In this example, the cutter 10 may include a protrusion 48 extending from the substrate 14 to selectively increase the thickness of the braze layer. The protrusion 48 is formed on the outer profile 18 of the substrate 14. The protrusion 48 is radially protruding into the substrate 14 and extends axially a length ($L_r$) for example, of between 5% to 90% of the overall length ($L_c$) of the cutter 10, for example, from 20% to 80% of the overall length of the cutter 10. The protrusion 48 in this example terminates below the cutting table 12 but could alternatively extend at least partially or fully through the cutting table 12 in an alternate configuration. Moreover, the protrusion 48 in this example extends to the bottom end 34 of the substrate 14 but could terminate prior to the bottom end 34 in other examples. The protrusion 48 may have a thickness ($t_p$) that ranges from 0.005 inches and 0.040 inches (0.127 mm to 1.016 mm). The cutter may have a single protrusion 48 that extends around the circumference of the substrate 14 or in alternative embodiments the cutter 10 may include multiple of the protrusion 48 that are spaced around the circumference of the cutter 10, for example.

Further illustrated on FIG. 16 is a representative body 22, which may be a portion of a bit body, for example. As illustrated, a cutter pocket 24 may be formed in the body 22. The cutter pocket 24 may have an inner profile 26. In the illustrated embodiment, the cutter 10 may be received in the cutter pocket 24 formed in the body 22. A gap or recess 28 comprising an annular groove exists between the outer profile 18 of the cutter 10, and the inner profile 26 of the cutter pocket 24 into which the cutter 10 is to be received. A braze material (i.e., a "braze) is a material, e.g., a braze alloy, used to secure the cutter 10 into the cutter pocket 24. The braze 30 may fill the entire space between the outer profile 18 of the substrate and the inner profile 26 of the cutter pocket 24. The outer profile 18 and inner profile 26 are generally shaped to conform to one another, except that the gap is thicker at the recess 16. The braze 30 may have a uniform thickness throughout the braze interface between the outer profile 18 of the cutter 10 and the inner profile 26 of the cutter pocket 24. However, the protrusion 48 on the cutter 10 functions as a standoff holding other portions of the cutter 10 further away from the inner profile 26 of the cutter pocket 24. As a result, the braze 30 has an increased thickness at portions of the braze interface where the protrusion 48 is not present.

Figure 17:
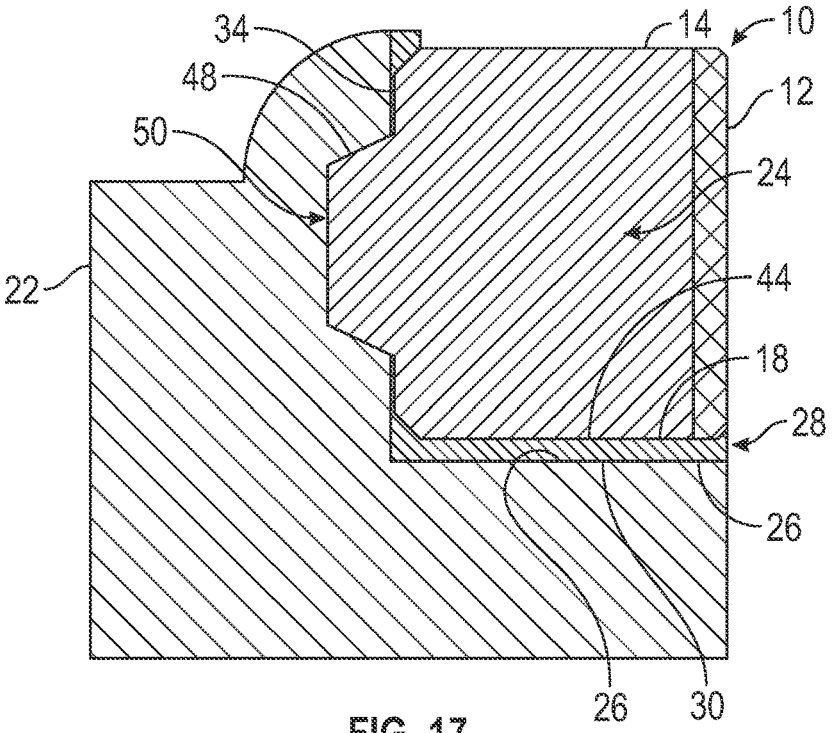
FIG. 17 is a cross-sectional side view of cutter with a protrusion in the back of the cutter, wherein the cutter is mounted in a cutter pocket in accordance with some embodiments of the present disclosure.
Figure 18:
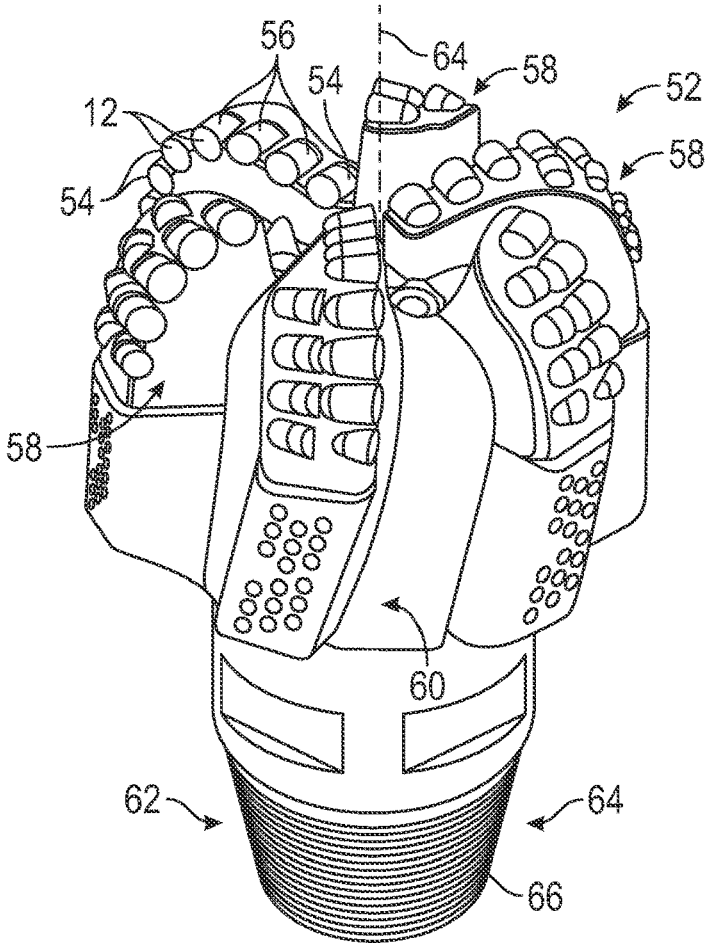
FIG. 18 is an isometric view of a fixed cutter drill bit in accordance with some embodiments of the present disclosure.

FIG. 17 illustrates a cutter 10 having a cutter table 12 secured to a substrate 14 in accordance with additional embodiments of the present disclosure. In this example, the cutter 10 may include a protrusion 48 extending from the substrate 14 to selectively increase the thickness of the braze layer. FIG. 17 further illustrates the cutter 10 disposed in a cutter pocket 24 in accordance with some embodiments. The cutter pocket is formed in a representative body 22, which may be a portion of a bit body, for example. The cutter pocket 24 may have an inner profile 26. In the illustrated embodiment, the cutter 10 may be received in the cutter pocket 24 formed in the body 22. The inner profile 26 of the cutter pocket 24 may include a pocket recess 50 that receives the protrusion 48. A gap or recess 28 comprising an annular groove exists between the outer profile 18 of the cutter 10, and the inner profile 26 of the cutter pocket 24 into which the cutter 10 is to be received. A braze material (i.e., a "braze) is a material, e.g., a braze alloy, used to secure the cutter 10 into the cutter pocket 24. The braze 30 may fill the entire space between the outer profile 18 of the substrate and the inner profile 26 of the cutter pocket 24. The outer profile 18 and inner profile 26 are generally shaped to conform to one another. In the illustrated embodiment, the gap 28 is not thicker at the protrusion 34. However, the gap 16 cooperates with the protrusion 42 to hold the cutter 10 in the cutter pocket 24 such that the portion of the gap 28 between the side 44 of the cutter 10 and the inner profile 26 of the cutter pocket 24 is increases, thus increasing the thickness of the braze 30 at that location.

In the illustrated embodiment, the cutter 10 may have similar attributes as the cutter 10 in FIG. 8. For example, a recess 16 comprising an annular groove is formed in the outer profile 18 of the substrate 14 to selectively increase the thickness of the braze layer. However, in contrast to the embodiment of FIG. 8, the recess 16 show on FIG. 8 has angled sidewalls 40. As illustrated, a cutter pocket 24 may be formed in the body 22, which may be a portion of a bit body. The cutter pocket 24 may have an inner profile 26. In the illustrated embodiment, the cutter 10 may be received in the cutter pocket 24 formed in the body 22. As illustrated, the inner profile 26 of the cutter pocket 24 may have a pocket protrusion 50 that receives the recess 16. A gap or recess 28 comprising an annular groove exists between the outer profile 18 of the cutter 10, and the inner profile 26 of the cutter pocket 24 into which the cutter 10 is to be received. A braze material (i.e., a "braze) is a material, e.g., a braze alloy, used to secure the cutter 10 into the cutter pocket 24. The braze 30 may fill the entire space between the outer profile 18 of the substrate and the inner profile 26 of the cutter pocket 24. The outer profile 18 and inner profile 26 are generally shaped to conform to one another. In the illustrated embodiment, the gap 28 is not thicker at the recess 18. However, the pocket protrusion 50 cooperates with the protrusion 48 to hold the cutter 10 in the cutter pocket 24 such that the portion of the gap 28 between the side 44 of the cutter 10 and the inner profile 26 of the cutter pocket 24 is increased, thus increasing the thickness of the braze 30 at that location.

FIG. 13 is an isometric view of a fixed cutter drill bit 52 according to an example configuration that may have stress reducing features at the braze joint between one or more cutters and cutter pockets. The drill bit 52 includes a plurality of fixed cutters positioned by virtue of their orientations on the bit body to directly engage an earthen formation when drilling. The fixed cutters in this example include round cutters 54. The fixed cutters optionally also include non-round, alternately referred to as "shaped" cutters 56 in reference to the shaped diamond tables external to the cutter pockets, which may be a separate issue from the shape of the braze joint internal to the cutter pockets according to this disclosure. The drill bit 40 is oriented upwardly in FIG. 13 for purpose of illustration, such as to show the arrangement of blades 58 on which the round cutters 54 and shaped cutters 56 are positioned. The drill bit 52 in this example has six blades 58 outwardly from a rotary bit body 60. Generally, blades 58 may have any of a wide variety of configurations including, but not limited to, substantially arched, helical, spiraling, tapered, converging, diverging, symmetrical, and/or asymmetrical.

The round cutters 54 and/or shaped cutters 56 are secured along the blades 58 at fixed and orientations. The round cutters 54 and shaped cutters 56 may each be placed on the drill bit 52 for a particular purpose, including but not limited to intended use as primary cutters, backup cutters, secondary cutters, gage cutters, and so forth, according to a particular drilling application. Each of the round cutters 54 and shaped cutters 56 may be directly or indirectly coupled to an exterior portion of the respective blade 42. For example, the round cutters 54 and fixed cutters 56 may be retained in recesses or cutter pockets (e.g., cuter cutter pocket 24 on FIG. 1) located on blades 58 of drill bit 41 with a brazing material, welding material, soldering material, adhesive, or other attachment material. As previously described, one or more of the round cutters 54 and shaped cutters 56 may include features to improve the brazing interface. For example, one or more of the round cutters 54 and/or shaped cutters 56 may include features (e.g., recess 16 or protrusion 48 as described herein) to selectively increase a thickness of a brazing layer. Although not required, one or more rolling cutters may also be mounted in rolling cutter pockets on the blades 58 allowing the rolling cutters to independently rotate within the rolling cutter pocket about its own cutter axis. With the exception of any rolling cutters, however, the round cutters 54 and shaped cutters 56 are fixed cutters that are not permitted to rotate about their cutter axes.

The drill bit 40 includes a connector 62 for coupling the drill bit 52 to a drill string (not shown). A method of drilling may comprise rotating the drill bit 52 about the bit axis 64 while engaging a formation with the cutters (e.g., round cutters 54 and shaped cutters 56) to cut, crush, shear, gouge, abrade, or otherwise disintegrate the formation. A drilling fluid may be circulated downhole through the drill string and drill bit 52 as generally understood in the art apart from the teachings of this disclosure. The connector 62 may comprise any suitable connector for the drill bit 52, as generally understood in the art apart from the specific teachings of this disclosure some examples of which may be prescribed by a standards body such as American Petroleum Institute (API) based on the bit type, size, drilling application, and other factors. See, e.g., API Specification 7—Specification for Rotary Drill Stem Elements. The 62 is embodied by way of example here as a shank 64 with drill pipe threads 66 formed thereon. The threads 66 may be used to threadedly connect with corresponding threads on another drill string component to releasably engage the drill bit 52 with a bottom hole assembly included in the drill string. Typically, the bit axis 64 will be aligned with (e.g., co-axial) with an axis of the drill string, although in specific applications like directional drilling the bit axis 62 may be deviated slightly with respect to the axis of the drill string. When coupled to the drill string, the drill bit 52 may be rotated around the bit axis 64 (and/or the axis of the drill string), such as by rotation of the whole drill string or by rotation of the drill bit 52 with respect to other parts of the drill string with a downhole motor in the bottomhole assembly ("BHA"). Each of the round cutters 54 and shaped cutters 56 may include a respective cutting table 12 that is positioned to engage a downhole formation to drill a wellbore by rotation of the drill bit 52.

The drill bit 52 may be designed and manufactured in accordance with teachings of the present disclosure to improve aspects of bit performance or specifically cutter performance by incorporating stress reducing features according to this disclosure. Bit performance and/or cutter performance can be characterized in terms of performance parameters, such as drilling speed and efficiency, rate of penetration, revolutions per minute (RPM), weight on bit (WOB), borehole diameter and quality, durability, force balancing, stick-slip reduction, and cutter wear, such as uniformity of cutter wear on shaped cutters, to list just some examples. Drill bit design parameters may be any aspect of the drill bit design that affects bit performance. Some drill bit design parameters affecting bit performance are specifically related to the cutters, including but not limited to cutter type, cutter shape, the number of cutters, their spacing, position, and orientation, and also the configurations of the cutter pockets and cutters and the resulting braze interfaces therebetween.

A system and method according to the present disclosure may improve drill bit performance relative to some reference (e.g., baseline values) by adjusting one or more bit design parameters including incorporation of stress reducing features at the braze joints to improve cutter performance and longevity. One aspect of this bit design may include generating a detailed computer model of the drill bit configuration including a baseline value of the design parameters and adjusting the design parameters such as to refine the brazing of the shaped cutters 56 on the blades 58 of the drill bit 52. A related aspect of bit design may include simulating drilling with the detailed computer model of a bit design to compare bit/cutter performance at a baseline value of the design parameter(s) with adjusted value(s) of the design parameter(s). This method may include simulating interactions between the various fixed cutters (shaped cutters 56 and round cutters 54) on the drill bit 52 and the geologic formation to determine how the round cutters 54 and shaped cutters 56 will individually and collectively perform in operation. The method may further include modifying the cutter and/or cutter pocket at an interface to improve the braze joint to improve cutter performance relative to a baseline value.

Figure 19:
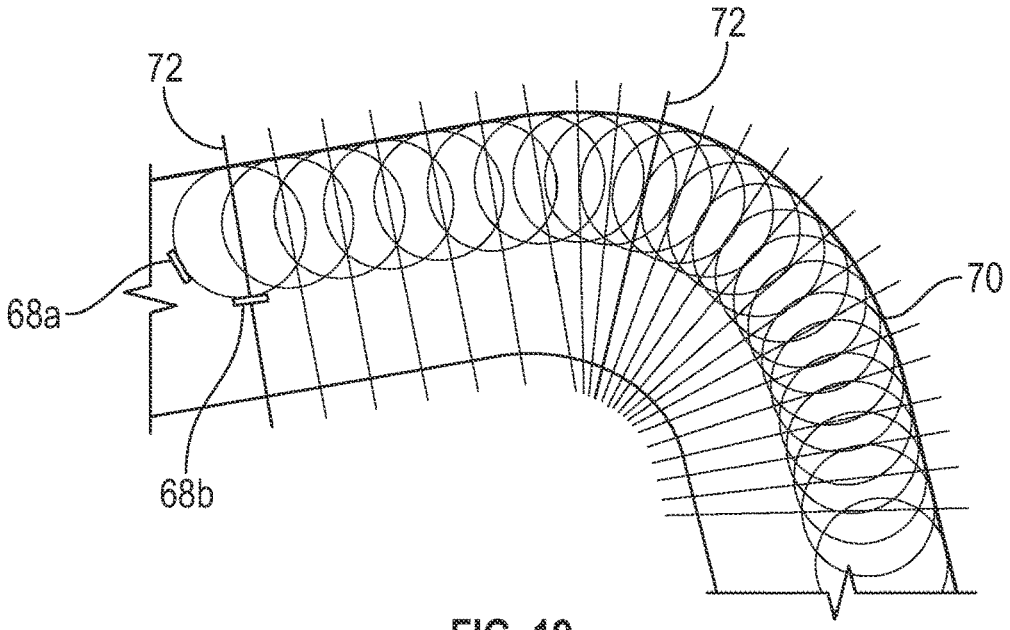
FIG. 19 is a schematic diagram of a cutter profile illustrating in accordance with some embodiments of the present disclosure.

FIG. 19 is a schematic diagram of a cutter profile illustrating some possible locations 68*a*, 68*b* of a recess (e.g., recess 16 disclosed herein) formed on the cutter 10 (e.g., cutter 10) and/or cutter pocket (cutter pocket 24) at the braze interface. A cutter profile line 70 is generally a reference line defined by the outermost, tangent points of the cutters along a particular blade that in theory may contact the formation being drilled. A cutter tilt axis 72 refers to the reference line through each cutter perpendicular to the cutter profile line. In many cases, the recess on cutter is intersected by, and may also be oriented perpendicular to, the cutter tilt axis 72 (i.e., parallel to the profile line at that cutter), such as at location 68*a*. This orientation sees the highest cutter loading from weight on bit. However, radial and drag forces also act on the cutter, and the force distribution varies in differing application. In some applications it may be desirable to orient the recess rotated circumferentially away from the position perpendicular to the cutter tilt line such as at location 120B to account for the increase in radial and drag loadings.

Accordingly, the present disclosure may provide improved longevity of fixed cutter drill bits by improving the brazing interface of the cutters with the cutter pockets of a bit body. The methods, systems, and apparatus may include any of the various features disclosed herein, including one or more of the following statements.

Statement 1. A drill bit, comprising: a bit body defining a rotational axis and having a plurality of cutter pockets formed thereon, each cutter pocket shaped to receive a respective substrate of a cutter with a cutting table secured thereon, wherein the substrate of at least one cutter has an outer profile defining an area of increased braze gap; and a braze interface comprising a braze alloy disposed in each cutter pocket between the inner profile of the cutter pocket and the outer profile of the respective substrate, such that a thickness of the braze alloy is greater at the area of increased braze gap.

Statement 2. The drill bit of statement 1, further comprising a uniform gap between the inner and outer profiles outside the area of increased braze gap.

Statement 3. The drill bit of statement 1 or statement 2, wherein the area of increased braze gap is along an annular gap defined between the cutter pocket and the substrate.

Statement 4. The drill bit of statement 3, wherein the cutter has a central cutter axis and a cutter length in an axial direction, and the area of increased braze gap has an axial length of between 5% and 90% of the overall cutter length.

Statement 5. The drill bit of statement 4, wherein the area of increased braze gap extends axially along the substrate and terminates below the cutting table.

Statement 6. The drill bit of statement 4, wherein the area of increased braze gap extends axially along the substrate and through at least a portion of the cutting table.

Statement 7. The drill bit of any one of statements 3 to 6, wherein the area of increased braze gap has a circumferential width of less than half of a perimeter of the substrate.

Statement 8. The drill bit of any one of statements 3 to 7, wherein the area of increased braze gap comprises an annular groove, which extends a full 360 degrees along the annular gap.

Statement 9. The drill bit of any preceding statement, wherein the area of increased braze gap is on a bottom end of the substrate.

Statement 10. The drill bit of claim 8, wherein the area of increased braze gap has a lateral width of between 5% and 90% of a width of the substrate.

Statement 11. The drill bit of any preceding statement, wherein the area of increased braze gap comprises a plurality of circumferentially spaced recess portions along an annular gap defined between the cutter pocket and the substrate.

Statement 12. The drill bit of any preceding statement, wherein a depth of the area of increased braze gap and the corresponding thickness of the braze alloy at the area of increased braze gap are between 0.010 inches and 0.030 inches.

Statement 13. The drill bit of any preceding statement, wherein the braze interface includes a region of compression and a region of tension under a drilling loading, and wherein the area of increased braze gap is positioned in the cutter pocket within the region of tension.

Statement 14. The drill bit of any preceding statement, wherein the braze alloy comprises at least one alloy selected from the group consisting of a copper-based alloy, a nickel-based alloy, a silver-based alloy, a gold-based alloys, and combinations thereof.

Statement 15. A braze joint, comprising: a cutter substrate having an outer profile; cutter pocket for receiving the cutter substrate and having an inner profile with a uniform gap between the inner and outer profiles outside an area of increased braze gap defined along the outer profile of the substrate; and a braze interface comprising a braze alloy disposed in each cutter pocket between the inner profile of the cutter pocket and the outer profile of the respective substrate, such that a thickness of the braze alloy is greater at the area of increased braze gap.

Statement 16. The braze joint of statement 15, wherein the area of increased braze gap is along an annular gap defined between the cutter pocket and the substrate, wherein the cutter has a central cutter axis and a cutter length in an axial direction, and the area of increased braze gap has an axial length of between 5% and 90% of the cutter length, and wherein the area of increased braze gap extends axially along the substrate and terminates below the cutting table or extends axially along the substrate and through at least a portion of the cutting table.

Statement 17. The braze joint of statement 15 or statement 16, wherein the area of increased braze gap has a circumferential width of less than half of a perimeter of the substrate.

Statement 18. The braze joint of any one of statements 15 to 17, wherein the area of increased braze gap comprises an annular groove, which extends a full 360 degrees along the annular gap.

Statement 19. The braze joint of any one of statements 15 to 18, wherein the area of increased braze gap is on a bottom end of the substrate and has a lateral width of between 5% and 90% of a width of the substrate.

Statement 20. A method of designing a drill bit, comprising: determining an expected loading on a plurality of fixed cutters received across a plurality of cutter pockets of a bit body; identifying one or more regions to increase a thickness of a braze interface between a fixed cutter and a corresponding cutter pocket of the plurality of cutter pockets; and selecting the shape of a substrate of the fixed cutter, to increase the resultant braze thickness at the one or more regions to spread out or otherwise redistribute the loading at the braze interface.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A drill bit, comprising:

a bit body defining a rotational axis and having a plurality of cutter pockets formed thereon, each cutter pocket shaped to receive a respective substrate of a cutter with a cutting table secured thereon, wherein the substrate of at least one cutter has an outer profile defining an area of increased braze gap, wherein the area of increased braze gap is along an annular gap defined between the cutter pocket and the substrate, wherein the cutter has a central cutter axis and a cutter length in an axial direction, and the area of increased braze gap has an axial length of between 5% and 90% of the overall cutter length, and wherein the area of increased braze gap extends axially along the substrate and is no more than 20% of the overall cutter length away from the front of the cutting table; and a braze interface comprising a braze alloy disposed in each cutter pocket between the inner profile of the cutter pocket and the outer profile of the respective substrate, such that a thickness of the braze alloy is greater at the area of increased braze gap.

2. The drill bit of claim 1, further comprising a uniform gap between the inner and outer profiles outside the area of increased braze gap.

3. The drill bit of claim 1, wherein the area of increased braze gap extends axially along the substrate and terminates below the cutting table.

4. The drill bit of claim 1, wherein the area of increased braze gap extends through at least a portion of the cutting table.

5. The drill bit of claim 1, wherein the area of increased braze gap has a circumferential width of less than half of a perimeter of the substrate.

6. The drill bit of claim 1, wherein the area of increased braze gap comprises an annular groove, which extends a full 360 degrees along the annular gap.

7. The drill bit of claim 6, wherein the area of increased braze gap has a lateral width of between 5% and 90% of a width of the substrate.

8. The drill bit of claim 1, wherein the area of increased braze gap comprises a plurality of circumferentially spaced recess portions along an annular gap defined between the cutter pocket and the substrate.

9. The drill bit of claim 1, wherein a depth of the area of increased braze gap and the corresponding thickness of the braze alloy at the area of increased braze gap are between 0.010 inches and 0.030 inches.

10. The drill bit of claim 1, wherein the braze interface includes a region of compression and a region of tension under a drilling loading, and wherein the area of increased braze gap is positioned in the cutter pocket within the region of tension.

11. The drill bit of claim 1, wherein the braze alloy comprises at least one alloy selected from the group consisting of a copper-based alloy, a nickel-based alloy, a silver-based alloy, a gold-based alloys, and combinations thereof.

12. A braze joint, comprising:

a cutter substrate having an outer profile;

a cutter pocket for receiving the cutter substrate and having an inner profile with a uniform gap between the inner and outer profiles outside an area of increased braze gap defined along the outer profile of the substrate, wherein the area of increased braze gap is along an annular gap defined between the cutter pocket and the substrate, and wherein the area of increased braze gap extends axially along the substrate and is no more than 20% of the overall cutter length away from the front of a cutting table secured to the cutter substrate; and a braze interface comprising a braze alloy disposed in the cutter pocket between the inner profile of the cutter pocket and the outer profile of the respective substrate, such that a thickness of the braze alloy is greater at the area of increased braze gap.

13. The braze joint of claim 12, wherein the cutter has a central cutter axis and a cutter length in an axial direction, and the area of increased braze gap has an axial length of between 5% and 90% of the cutter length, and wherein the area of increased braze gap extends through at least a portion of the cutting table.

14. The braze joint of claim 12, wherein the area of increased braze gap has a circumferential width of less than half of a perimeter of the substrate.

15. The braze joint of claim 12, wherein the area of increased braze gap extends a full 360 degrees along the annular gap.

* * * * *